US006726390B2

(12) United States Patent
van Steenbergen

(10) Patent No.: US 6,726,390 B2
(45) Date of Patent: Apr. 27, 2004

(54) DEPILATION

(76) Inventor: Mark van Steenbergen, Frankrijkstraat 11, Temse, B-9140 (BE)

( * ) Notice: Subject to any disclaimer, the term of this patent is extended or adjusted under 35 U.S.C. 154(b) by 0 days.

(21) Appl. No.: 10/221,977

(22) PCT Filed: Apr. 18, 2001

(86) PCT No.: PCT/GB01/01756

§ 371 (c)(1),
(2), (4) Date: Dec. 17, 2002

(87) PCT Pub. No.: WO01/78550

PCT Pub. Date: Oct. 25, 2001

(65) Prior Publication Data

US 2003/0133736 A1 Jul. 17, 2003

(30) Foreign Application Priority Data

Apr. 18, 2000 (GB) ..... 0009729.5

(51) Int. Cl.[7] ..... B43M 11/02; B05C 17/00

(52) U.S. Cl. ..... 401/220; 401/208; 492/30; 492/33

(58) Field of Search ..... 401/208, 218, 401/220, 197, 219; 492/28, 30, 33, 35, 16, 17

(56) References Cited

U.S. PATENT DOCUMENTS 3,063,085 A * 11/1962 Thomas ..... 401/220
4,752,148 A * 6/1988 Mann ..... 401/208
D299,974 S * 2/1989 Schmitt ..... D28/7

* cited by examiner

*Primary Examiner*—David J. Walczak
(74) *Attorney, Agent, or Firm*—Caesar, Rivise, Bernstein, Cohen & Pokotilow, Ltd.

(57) ABSTRACT

Hair is removed from the skin using an applicator comprising a dispenser to be mounted on an open container of depilatory material, the dispenser comprising a housing containing a roller having ribs, the facing wall of the housing having recesses by which depilatory material is applied to the skin in a substantially even thin layer.

6 Claims, 1 Drawing Sheet

DEPILATION

The invention relates to a device for removing hair from the body. It is known to apply heated and thus liquid depilatory wax to the skin and then remove the solidified wax from the skin taking with it hairs captured in the wax. Typically the wax material is presented in a bottle, and is heated therein, and is then passed over in a roller in a dispenser fitted to the bottle to form the wax layer on the skin.

This invention is based on the discovery that a new design of dispenser offers certain advantages.

According to the invention in one aspect there is provided an applicator for use in depilation, the applicator comprising a container having an outlet for release of heated depilatory material contained in the container, a dispenser mounted on the container adjacent the outlet, the dispenser comprising a housing containing a ribbed roller, a gap being present between the roller and a facing wall of the housing, recesses being present in that facing wall so that the heated material flows from the outlet over the roller and between the ribs and the recesses to form a substantially even layer on the skin.

Preferably the roller has circumferential ribs. Neighbouring ribs define grooves, the presence of which provides for a more even flow of the heated depilatory material.

Preferably the distance between adjacent recesses is greater than that between neighbouring ribs on the roller. The depilatory material may be selected from any of the available materials. Preferably the material comprises or includes a pine rosin. Such a composition can be heated to 40° C. to make it liquid; the use of a material which is liquid at that temperature is particularly cool and comfortable to the skin.

As a result of the formulation selected and the shaping of the roller and the presence of the recesses in the facing wall of the housing it is possible to apply a particularly thin layer of material. This will usually be less than 0.4 mm and even as thin as 0.3 mm. As a result the customer being treated will feel more comfortable and less material will be used so the treatment is particularly economic.

In another aspect the invention provides a method of removing hair from the skin, using an applicator as just defined, the method comprising fitting the dispenser on to the outlet of the container and heating the depilatory material in the container until it is flowable, inverting the heated container and holding it at an angle of about 45° to the skin to be treated; then moving the applicator so as to apply a thin coat of the material; allowing the material to solidify and so trap hairs; applying a tear off strip to the solidifying layer and pulling off the strip in a direction against that of the hair growth.

Preferably the container is a bottle having a neck on which sits a removable cap, typically the cap is held on by a screw thread connection. For use, the cap is removed and the dispenser fitted. The bottle is placed in a heater to heat up the contained solid material typically to about 40° C., to make it flowable. The heated bottle is then removed from the heater apparatus and inverted so that the flowable material will exit the outlet in the neck on to the roller. The wall of the housing is relieved at spaced apart locations opposite the roller so that when the material flows through the neck of the bottle on to the roller which is then rotated, the heated material will spread, guided by the recesses on the housing side wall to form a narrow substantially uniform layer on the skin, about 0.3 mm thick.

Preferably the material is based on pine rosin; the use of rosin is particularly advantageous in that it causes few, if any, allergic reactions.

In order that the invention may be well understood it will now be described by way of example with reference to the accompanying diagrammatic drawings, in which.

The bottle 1 has a neck 2 threaded on the outside for reception of a screw threaded cap 3. The bottle contains a pine rosin based composition which is solid at room temperature but which will flow when heated to say 50° C. or more. Preferably the composition is colophonium, hydrogenated coconut oil, paraffinium liquidum, glyceryl hydrogenated rosinate.

Figure 1:
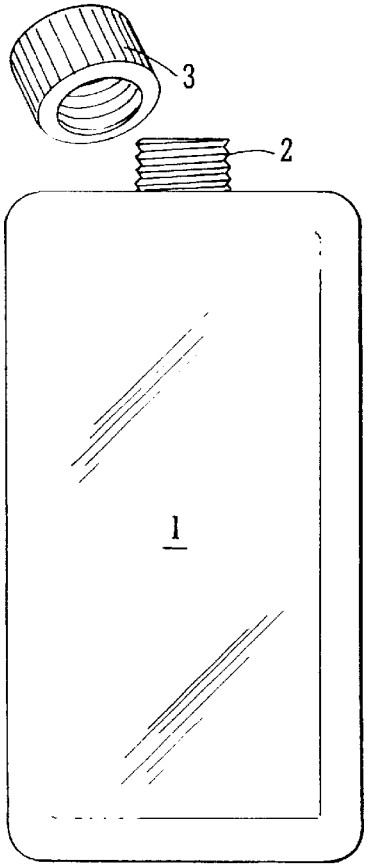
FIG. 1 is an elevation of one bottle with a detachable cap.
Figure 2:
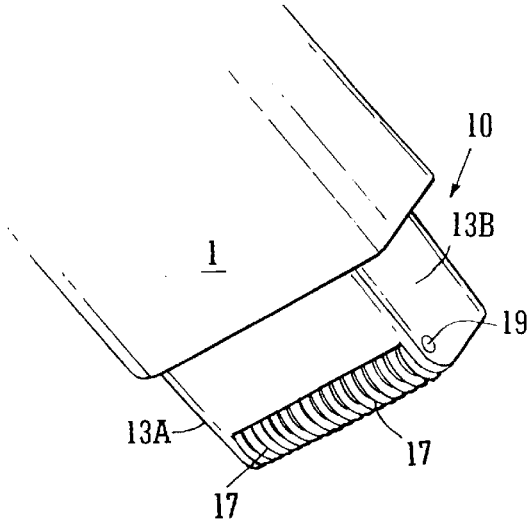
FIG. 2 is an underneath perspective view of one dispenser fitted to the bottle.
Figure 3:
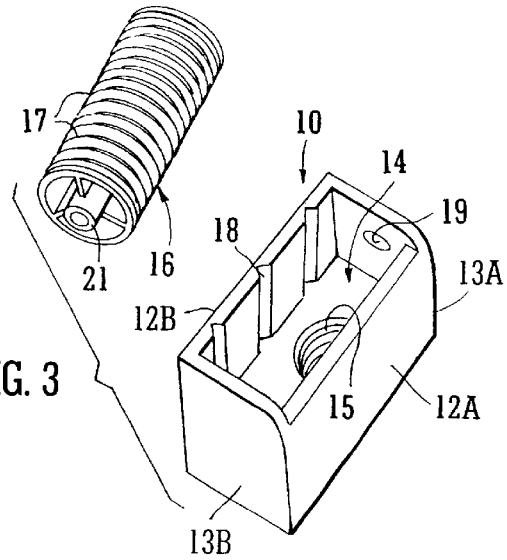
FIG. 3 is an exploded perspective view of a dispenser.
Figure 4:
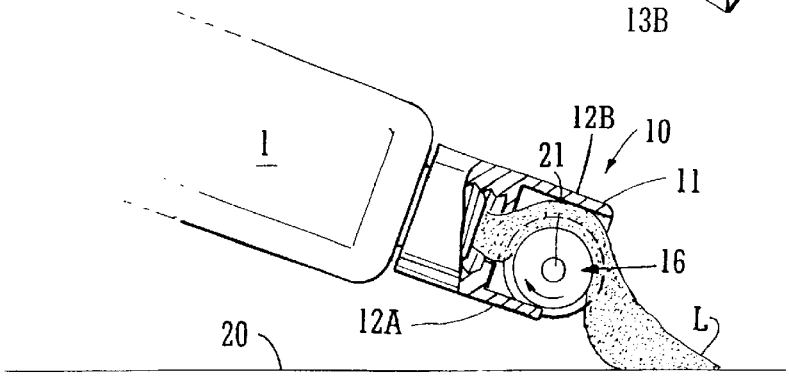
FIG. 4 is an elevation partly in section of a device in use in the method of the invention.

The dispenser 10 comprises a coffin-like housing having two elongate side walls 12A/12B and end walls 13A/13B. The mouth 14 is open. A threaded hole 15 is disposed in a portion of the housing to engage the neck 2 of the bottle. A roller 16 is fitted between the end walls 13A/13B and extends along the housing. As shown in FIG. 3, holes 19 are present in the end walls 13A/13B to receive an axle 21 by which the roller 16 is mounted in position. The roller 16 has circumferential ribs 17 which are spaced closely together. Recesses 18 are present in the interior surface of the sidewall 12B facing the ribs 17. The recesses 18 are spaced apart by a distance greater than that between the ribs 17. As can be seen most clearly in FIG. 4, side wall 12B is longer than side wall 12A and therefore side wall 12B comprises a roof 11 that contains the recesses 18 therein.

When the treatment is to be carried out the dispenser 10 is fitted on to the neck 2 and the unit placed in a heater, not shown. When the temperature reaches say 40° C. the rosin will flow. The bottle is removed from the heater and held at about 45° to the surface to be treated. The bottle is moved along the skin 20, the rosin flowing out of the neck 2 over the roller 16 and between the roller 16 and the recesses 18 to form a substantially even layer L about 0.3 mm thick. Because the liquid passes through the grooves between the ribs and the recesses 18 it is distributed evenly and flows better. Because the material contains a pine rosin it will adhere better to the skin and cause less allergic reactions. In addition, the use of the pine rosin at about 40° C. is particularly comfortable to the skin. The bottle is reverted, and the dispenser removed and the cap 3 screwed on. The layer L solidifies to trap hairs. A tear off strip, not shown, is added and then the whole pulled off in a direction against that of hair growth to remove the hair.

What is claimed is:

1. An applicator for use in depilation of hair on the skin, the applicator comprising a container having an outlet for release of heated depilatory material contained in the container, a dispenser mounted on the container adjacent the outlet, the dispenser comprising a housing containing a ribbed roller, a roof spaced from the periphery of the ribbed roller, and recesses present in said roof for cooperating with the ribs whereby, in use, the heated material flows from the outlet over the roller and between the ribs and the recesses to form a substantially even thin layer of depilatory material on the skin.

2. An applicator according to claim 1, wherein the distance between neighboring recesses is greater than that between neighboring ribs on the roller.

3. An applicator according to claim 1, wherein the recesses are present in the interior surface of said roof.

4. A method of removing hair from the skin, the method comprising fitting a dispenser on to the outlet of a container of the depilatory material, the dispenser comprising a housing containing a ribbed roller, a gap being present between the roller and a roof of the housing, recesses being present in that roof; then heating the material in the container until it is flowable, and inverting the heated container and holding it at an angle of about 45° to the skin to be treated; then moving the applicator over the skin to apply a thin coat of the heated depilatory material; allowing the material to solidify and so trap hairs; applying a tear off strip to the solidifying layer and pulling off the strip in a direction against that of the hair growth.

5. A method according to claim 4, wherein the layer is applied to a thickness of about 0.3 mm.

6. A method according to claim 4, where the depilatory material comprises a pine rosin.

* * * * *